US008046936B1

(12) United States Patent
Simon

(10) Patent No.: US 8,046,936 B1
(45) Date of Patent: Nov. 1, 2011

(54) REMOVABLE SHOE HEEL ASSEMBLY FOR WOMEN'S FOOTWEAR

(75) Inventor: Lisa Simon, Lawai, HI (US)

(73) Assignee: Lisa Simon, San Diego, CA (US)

( * ) Notice: Subject to any disclaimer, the term of this patent is extended or adjusted under 35 U.S.C. 154(b) by 869 days.

(21) Appl. No.: 12/011,452

(22) Filed: Jan. 28, 2008

Related U.S. Application Data

(60) Provisional application No. 60/900,155, filed on Feb. 7, 2007.

(51) Int. Cl.
*A43B 21/36* (2006.01)

(52) U.S. Cl. ..... 36/42

(58) Field of Classification Search ..... 36/42, 41, 36/36 R
See application file for complete search history.

(56) References Cited

U.S. PATENT DOCUMENTS 2,050,644 A * 8/1936 Book et al. ..... 36/34 R
2,187,167 A * 1/1940 Mayor ..... 36/42
2,582,551 A * 1/1952 Malherbe ..... 36/42
2,795,866 A * 6/1957 Perugia ..... 36/24.5
2,795,867 A * 6/1957 Zuckerman et al. ..... 36/42
4,219,946 A * 9/1980 Baum ..... 36/42
4,400,893 A 8/1983 Musci
5,477,625 A 12/1995 Goldsmith
5,675,916 A * 10/1997 Lewis ..... 36/36 R
6,442,871 B2 9/2002 Doerer
6,631,570 B1 10/2003 Walker
2010/0139123 A1 * 6/2010 Alan et al. ..... 36/100

* cited by examiner

*Primary Examiner* — Ted Kavanaugh
(74) *Attorney, Agent, or Firm* — Lisa Simon

(57) ABSTRACT

A removable shoe heel assembly that allows removal of a woman's shoe or boot heel, preferably a circular shaped housing unit configured to the underside of a woman's shoe or boot shank having a gravity lock to prevent movement when the removable shoe heel is attached. The gravity lock settles into a first furrow disposed in the housing unit and falls into a second furrow disposed in the removable shoe heel when turned upright, in a vertical position, both parts having a connecting means and a receiving means, respectively. By turning the woman's shoe or boot upside down the gravity lock falls into the first furrow area thereby making removal and reattachment of the removable shoe heel possible.

7 Claims, 1 Drawing Sheet

REMOVABLE SHOE HEEL ASSEMBLY FOR WOMEN'S FOOTWEAR

This application claims the benefits of priority under 35 U.S.C. 119 of Provisional Application No. 60/900,155 filed Feb. 7, 2007.

BACKGROUND OF THE INVENTION

The present invention relates to women's footwear, either a shoe or boot that has no means of changing styles due to the current nature of permanent heel attachment. The invention described herein allows women to change any shoe style with a new heel, at the discretion of the wearer. The invention is therefore of great use for women who desire to express individual style or need to transport many shoes styles when traveling. The current method of securing a heel relies on nails, brads, cement, etc. and is currently permanently secured. Although shoe heels are permanently secured they do, however, break off. The current invention herein is neither obvious nor anticipated, whereby a more secure method is invented and resists breakage and allows women the great advantage of changing the design of any pair of shoes in this shoe line.

There have been patents for shoe heels that are removable; however there are none with the current method that uses the present invention, herein, to secure a removable shoe heel and prevent removal until desired. Accordingly, what is desired, and has not heretofore been developed and is new and unobvious, is a removable shoe heel assembly. It is further desired that the shoe maintain the basic appearance of a typical shoe. Finally, it is desired that the method of making a removable women's shoe or boot heel be easy to manipulate with no need for outside tools or pieces that one could lose or misplace. The related art follows:

U.S. Pat. No. 6,631,570 B1 Walker. Oct. 14, 2003
U.S. Pat. No. 6,442,871 B2 Doerer, Sep. 3, 2002
U.S. Pat. No. 5,477,625 A Goldsmith, Dec. 26, 1995
U.S. Pat. No. 4,400,893 A Musci, Aug. 30, 1983

Walker invented a product that could eventually twist apart, the present invention has a locking part that prevents accidental movement. Goldsmith uses a strap that could eventually harm the wearer that is also unsightly, and uses a part that could eventually become lost, the present invention that I have designed has no parts to lose and nothing that could harm the wearer. Musci invented parts that will become easily breakable due to the nature of the design, the new invention has no parts that will easily break thereby making the invention a wearable shoe that possesses many style changes and will be successful in the market.

U.S. Pat. No. 2,050,644 A Book, 18-1936
U.S. Pat. No. 2,187,167 A Mayor, 01-1940
U.S. Pat. No. 2,582,551 A Gerhardus, 01-1952
U.S. Pat. No. 2,795,866 A Perguia, 06-1957
U.S. Pat. No. 2,795,867 A Zuckerman et al, 06-1957
U.S. Pat. No. 4,219,946 A Baum, 09-1980
U.S. Pat. No. 5,675,916 A Lewis, 10-1997
US-2010/0139123 A1, Alan et al, 06-2010

Book uses a screw penetrating from the heel tip to the shoe sole. The design could cause the heel to fracture or break with normal use causing injury to the wearer and has ancillary parts that could be lost. The Applicant's invention seats a removable housing assembly in the shoe sole and heel and uses a locking system, thus creating a very secure and easy to operate design with no ancillary parts to lose and is not an assumption or supposition of Book.

Mayor seeks to disconnect a portion of a shoe heel with a sliding action so as to re-connect a lift or heel tip. This design is distinguishingly different from the Applicant's invention because Applicant wishes to remove the entire heel from the sole to attach a new and different style of heel and uses a removable housing assembly in the heel and sole with a gravity lock, and is not assumed or supposed by Mayor.

Gerhardus relates to a heel lifting device with a tongue and groove that is unrelated to the Applicant's invention. Gerhardus also has an unsightly design while the Applicant's invention uses a removable housing assembly in the sole and heel creating no visual difference from a conventional shoe when attached.

Perugia uses a mortise slide and lugs and tenon that slides forward and backward. This could create injury to the wearer due to premature disengagement. The Applicant's invention substantially differs from Perugia and uses a removable housing assembly in the sole and heel with a gravity lock that prevents any movement or disengagement.

Zuckerman uses a shoe stiffener with an enlarged plate and dovetail grooves whereby a pin is inserted by pulling up the shoe sole. By contrast, the Applicant's invention uses a removable housing assembly in the sole and heel with a gravity lock and has no additional parts to insert for placement and is not assumed or supposed by Zuckerman.

Baum uses a screw method of securing a heel; however, no reference is made for a pass through slot or locking device, that when attached to the shank, would create a very durable attachment and prevent movement. The Applicant's invention embodies a design that was not assumed, and is non-obvious and addresses the issue of easily removing the heel, locking another choice of heel when desired, by using a removable housing assembly in the sole and heel with a gravity lock.

Lewis uses another method of a screw device and a plug, using manual insertion under the sole. The Applicant's invention uses no ancillary parts that require manual adjustment and substantially differs from Lewis.

Alan uses an unsightly design with an off-putting sole/heel that will require very costly retooling and overhead. The use of a pin extending through to the shoe heel tip could cause cracking or breakage during normal wear due to force and pressure. Also, the use of the shoe heel tip to remove the heel requires much time to operate. The Applicant's current invention uses easily manufactured parts, making it easy and cost effective to retrofit the current method of shoe making. Also, the current invention uses a removable housing assembly in the sole and heel taking seconds to operate that locks into place, and substantially differs from and is not a conclusion or supposition of Alan's.

SUMMARY OF THE INVENTION

It is an object of the present invention to provide an easy method to allow a removable woman's shoe or boot heel for every woman to express individual shoe style and having no ancillary parts that could be lost.

It is an object of the present invention to provide a woman with a way to remove their shoe or boot heel, adding another heel that would be resistant to accidental breakage. The current invention is many times stronger than current methods of attachment with nails, brads, cement, etc.

It is an object of the present invention to provide a removable woman's shoe or boot heel that maintains the general appearance of a typical looking shoe or boot, without anyone knowing that there are copious amounts of style changes in one pair of shoes, just by changing the removable shoe heel.

The above objects, features, and advantages of the present invention become apparent from the following detailed description and read with the accompanying drawings, which illustrate by way of example, the principles of the invention. The reference numbers are used to identify the parts in the accompanying drawings.

A is the shank of the shoe.

B is the housing unit secured to the shank through the pass through slot.

Figure 2:
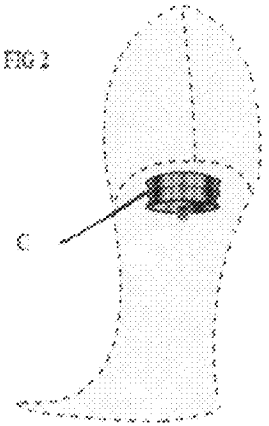
Figure 4:
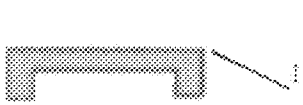

FIG. 2 is a perspective view from the back of the shoe showing the housing unit's connecting means C and the exposed gravity lock FIG. 4.

Figure 1:
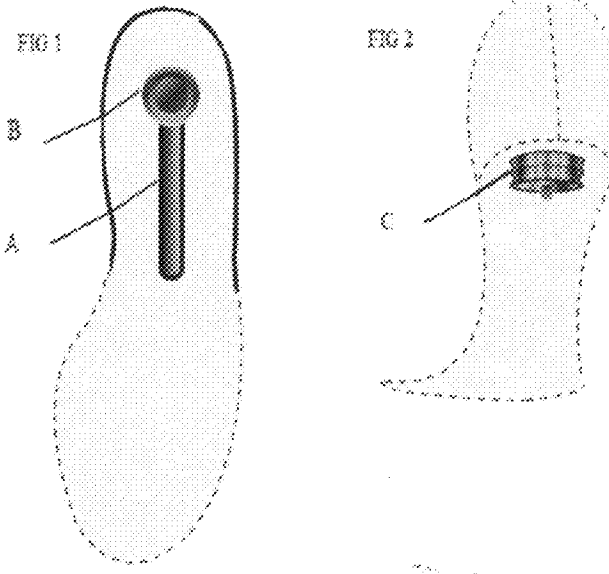
FIG. 1 is an above view of the sole area where the shank is inserted through the pass through slot of the housing unit.
Figure 3:
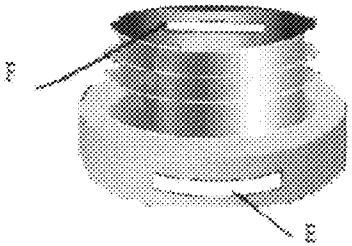

FIG. 3 is a view of the housing unit turned upside down; a first furrow slot shown as F, also showing the pass through slot E to receive a shank FIG. 1 A.

FIG. 4 is a side view of the gravity lock.

Figure 5:
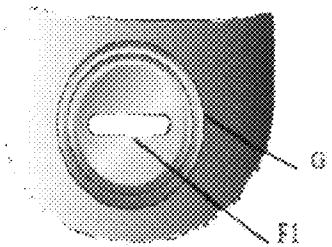

FIG. 5 is an above view of the removable shoe heel, showing the second furrow F1 and receiving means G.

Figure 6:
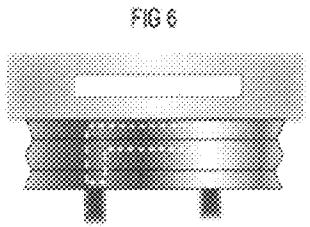

FIG. 6 is a side view of the housing unit in a vertical position showing at least one oblong leg of the gravity lock FIG. 4.

Figure 7:
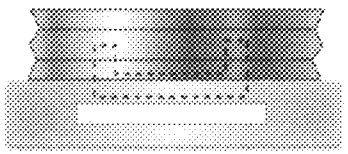

FIG. 7 is view of the housing unit when turned upside down where the gravity lock is not visible.

Figure 8:
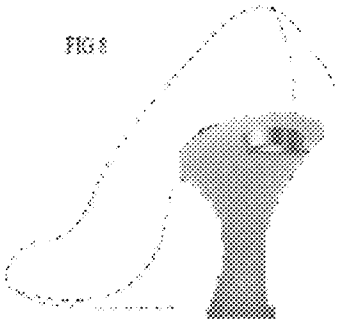

FIG. 8 is a see through view of the receiving unit when the removable shoe heel is attached.

Figure 9:
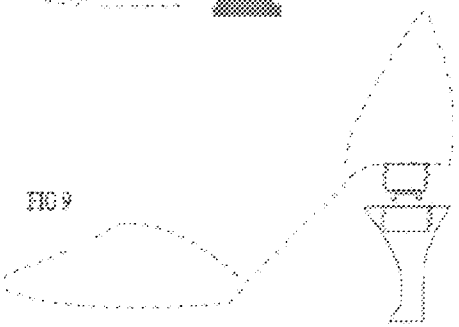

FIG. 9 is a view of the disassembled shoe assembly.

Figure 10:
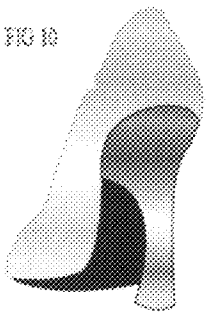

FIG. 10 is a back view of the removable shoe heel assembly when engaged to form a complete shoe.

Detailed Description of the Invention

Referring to the drawings for a skilled artisan to manufacture and give a layperson a definitive understanding. It is preferred by the present invention that a conventional looking shoe FIG. 10 will be attained when the method for assembly is followed, therefore, FIG. 9 shows an overall view of a removable shoe heel assembly where the housing unit FIG. 3 extends from the shoe sole and will accept the removable shoe heel FIG. 8. It is understood that a hole must be made through a conventional shoe sole to expose said housing unit and that the hole is defined by said housing unit. Both housing unit FIG. 3 and removable shoe heel FIG. 8 is preferably made of rigid materials and are injection molded to maintain maximum tolerances and controls. The housing unit FIG. 3 is preferably round in shape and similar looking to a conventional bolt shape and follows the geometric shape of the shoe sole area FIG. 1, for the comfort of the wearer, and is less then 3 inches in diameter and less than 3 inches in depth. FIG. 1 shows the sole portion of a conventional shoe where the shank A is fitted into a pass through slot E of the housing unit FIG. 3. The pass through slot E is defined by the shoe shank A and is permanently secured with glues or such bonding materials as to make a permanent connection. Said pass through slot E terminating in a predetermined depth. The housing unit FIG. 3 comprises a connecting means C that constitutes male threading. The housing unit FIG. 3 further comprises a first furrow F where a gravity lock FIG. 4 will be housed, said gravity lock will prevent movement when a removable shoe heel FIG. 8 is attached. The gravity lock FIG. 4 is preferably bench shaped having at least one oblong shaped leg defined by a second furrow F1 located in the removable shoe heel FIG. 8, said gravity lock FIG. 4 further comprising at least one arm I that overextends into first furrow F in a generally small gully way of said first furrow F, so that said gravity lock FIG. 4 does not exit first furrow F. FIG. 6 shows the unattached housing unit FIG. 3 when turned in a right side up, vertical position prior to being adhered to the shoe shank A, where the ends of the gravity lock FIG. 4 are exposed. FIG. 7 shows a view of the housing unit FIG. 3 turned in an upside down position prior to attachment.

An above view of the removable shoe heel FIG. 5 comprises a receiving means G that constitutes concave female threading, defined by said connecting means C. The receiving means is less than 3 inches in diameter and less than 3 inches in depth. FIG. 5 shows an above view of the removable heel FIG. 8 where a second furrow F1 being disposed midway between receiving means G wherein said receiving means is circumferentially disposed about said second furrow F1.

It is reasonably understandable that when the shoe is turned in an upside down position the gravity lock FIG. 4 will settle into the first furrow F and removal of the removable shoe heel FIG. 8 is easily maneuvered by counter clockwise rotation. Subsequently, it is understandable that when the shoe is turned in an upright, vertical position, the gravity lock FIG. 4 settles into the second furrow F1, preventing any movement so the wearer has a conventional looking shoe but has the added ability to change the look and style of the shoe when desired and also having another benefit of a very secure shoe heel.

What is claimed is:

1. A removable shoe heel assembly for facilitating many styles of shoes comprising:

a sole having a shank therein;

a removable shoe heel having a female fastener; and a generally circular shaped, rigid housing unit having a pass through slot, a first furrow, a male fastener circumferentially surrounding said first furrow and a gravity lock contained within said housing unit;

whereby said shank is permanently secured to said housing unit through the pass through slot, said male fastener is secured to said female fastener for detachably securing said removable shoe heel to said sole, said gravity lock has at least one leg and is disposed midway between said male fastener, said female fastener circumferentially surrounding a second furrow disposed on the removable shoe heel midway between said female fastener to receive said gravity lock when said male fastener is rotationally turned to connect said housing unit with said removable shoe heel, wherein said gravity lock having said least one leg moves from a first position to a second position through the first furrow to lock, stabilize and prevent movement between the removable shoe heel and the sole together; and when said assembly is turned in an upside down position the gravity lock is withdrawn from the first furrow into the housing unit to the first position to permit said removable shoe heel to be rotatably detached from said sole.

2. The housing unit set forth in claim 1 wherein the male fastener has downward spiraling male threads of predetermined pitch and ending in a predetermined depth.

3. The housing unit set forth in claim 1 wherein the gravity lock is preferable bench shaped having two slender oblong legs.

4. The removable shoe heel set forth in claim 2 wherein the female fastener has concave spiraling female threads to secure with the male fastener.

5. The housing unit and removable heel of claim 2 wherein the first and second furrow is in apposition and parallel to each other in separate respective planes when said housing unit and said removable heel are connected allowing movement of said gravity lock to fall downward when turned upright or upside down.

6. The housing unit and removable shoe heel of claim 2 wherein the housing unit and the removable shoe heel are made out of rigid resilient injection molded plastics.

7. The housing unit of claim 2 wherein said housing unit does not exceed 3 inches in diameter or 3 inches in depth.

* * * * *